United States Patent [19]

Rüge et al.

[11] Patent Number: 4,843,808

[45] Date of Patent: Jul. 4, 1989

[54] METHOD AND DEVICE FOR MONITORING THE QUALITY OF YARNS AND WOUND PACKAGES PRODUCED BY AND THE QUALITY OF OPERATION OF A TEXTILE MACHINE

[75] Inventors: Joachim Rüge, Monchen-Gladbach; Edmund Wey, Nettetal; Gregor Gabald, Monchen-Gladbach, all of Fed. Rep. of Germany

[73] Assignee: W. Schlafhorst & Co., Fed. Rep. of Germany

[21] Appl. No.: 181,390

[22] Filed: Apr. 14, 1988

[30] Foreign Application Priority Data

Apr. 14, 1987 [DE] Fed. Rep. of Germany ..... 3712654

[51] Int. Cl.[4] ..... D01H 9/18; D01H 9/00; B65H 67/06

[52] U.S. Cl. ..... 57/264; 57/265; 57/276; 57/281; 242/35.5 A

[58] Field of Search ..... 57/264–266, 57/276, 281, 274; 242/35.5 R, 35.5 A, 35.6 R; 73/159, 160; 364/470

[56] References Cited

U.S. PATENT DOCUMENTS

| | | | |
|---|---|---|---|
| 3,263,499 | 8/1966 | Gith et al. | 242/35.6 R X |
| 3,648,026 | 3/1972 | Abe et al. | 242/36 X |
| 3,648,027 | 3/1972 | Ganong, Jr. et al. | 242/36 X |
| 3,789,595 | 2/1974 | Bernstein et al. | 57/264 |
| 4,136,511 | 1/1979 | Raasch | 57/265 |
| 4,351,494 | 9/1982 | Schippers et al. | 57/265 X |
| 4,553,708 | 11/1985 | Matsui et al. | 242/35.5 A X |
| 4,561,602 | 12/1985 | Schippers et al. | 242/35.5 A |
| 4,660,370 | 4/1987 | Matsui et al. | 57/281 |
| 4,666,096 | 5/1987 | Heel et al. | 242/36 |
| 4,685,629 | 8/1987 | Sugioka | 242/18 R |

FOREIGN PATENT DOCUMENTS

| | | |
|---|---|---|
| 0026472 | 4/1981 | European Pat. Off. . |
| 0196090 | 10/1986 | European Pat. Off. . |
| 3240486 | 1/1985 | Fed. Rep. of Germany . |
| 3438962 | 4/1986 | Fed. Rep. of Germany . |
| 2635714 | 5/1986 | Fed. Rep. of Germany . |
| 3603002 | 8/1986 | Fed. Rep. of Germany . |
| 3344993 | 1/1987 | Fed. Rep. of Germany . |
| 3628045 | 3/1987 | Fed. Rep. of Germany . |
| 2170495 | 9/1973 | France . |
| 2556747 | 6/1985 | France . |
| 410718 | 10/1966 | Switzerland . |

OTHER PUBLICATIONS

"Microelectronics—Present and Future Applications in Spinning"; Melliand Textilberichte; pp. 401–407; Jun., 1985.

"Yarn Uneveness Measuring"; Textil Praxis International; pp. 1287 and 1288; Dec. 1986.

*Primary Examiner*—John Petrakes

*Attorney, Agent, or Firm*—Shefte, Pinckney & Sawyer

[57] ABSTRACT

Bobbins spun in a ring spinning machine are conveyed sequentially to a measuring, counting and sorting device located between the ring spinning machine and an automatic winder that winds yarn from the bobbins. The measuring, counting and sorting device senses the presence of a bobbin, counts the bobbins being sensed, senses yarn and bobbin characteristics and compares the characteristics with predetermined standards. The device separates bobbins whose characteristics differ from the standard. Data regarding the operation of the spinning machine and operation of the winding machine are combined with the data obtained by the measuring, counting and sorting device and statistically evaluated for display or for controlling the production of the spinning machine and winding machine or for controlling conveyance of the packages from the winding machine.

22 Claims, 2 Drawing Sheets

FIG. 1
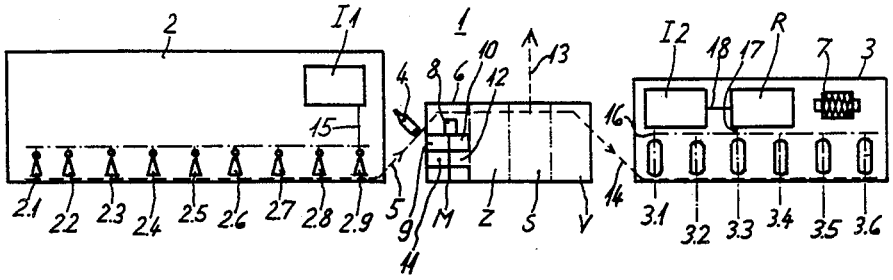
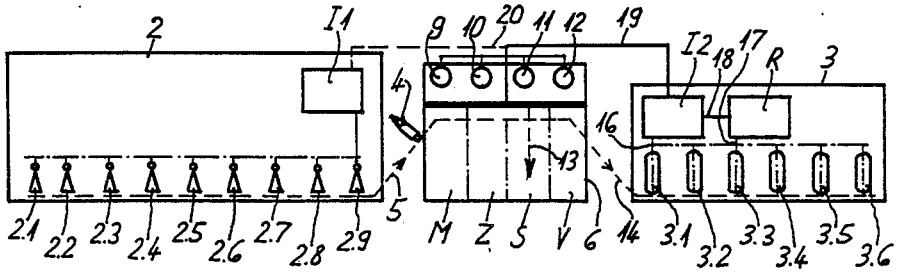
FIG. 2
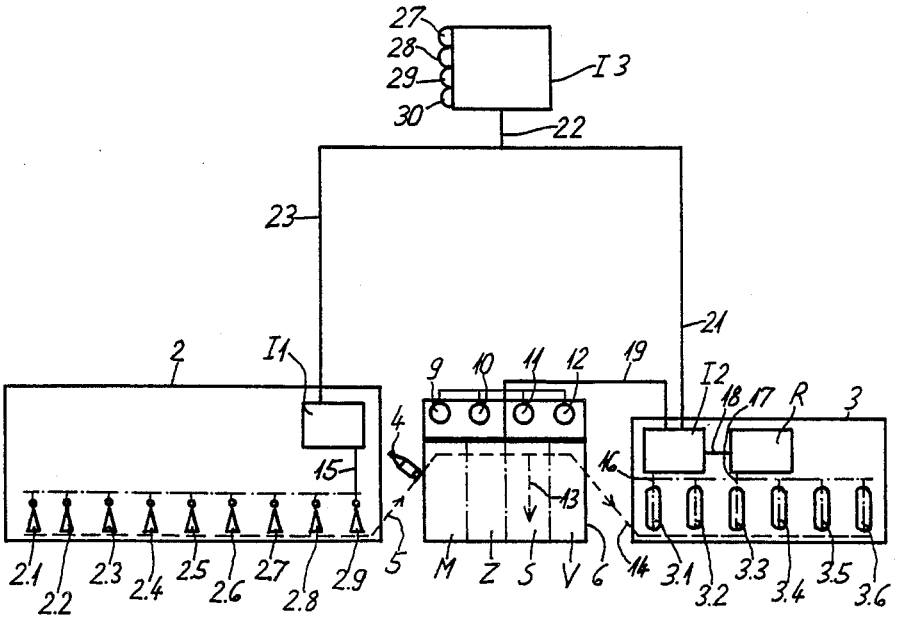
FIG. 3

METHOD AND DEVICE FOR MONITORING THE QUALITY OF YARNS AND WOUND PACKAGES PRODUCED BY AND THE QUALITY OF OPERATION OF A TEXTILE MACHINE

BACKGROUND OF THE INVENTION

The present invention relates to a method and device for monitoring the quality of yarns and wound packages, and the quality of operation at production stations in a textile machine in which at least one ring spinning machine is combined with at least one automatic winder.

Combining ring spinning machines and automatic winders increases efficiency and reduces operating costs, but requires automatic monitoring and control to maintain proper operating conditions and provide quality yarn and yarn packages. The present invention is directed to improving such automatic monitoring to obtain enhanced production results.

SUMMARY OF THE INVENTION

Briefly described, the present invention provides a method of and device for monitoring the quality of yarns and wound packages produced and the quality of operation at production stations in a textile machine in which at least one ring spinning machine is combined with at least one automatic winder. The method includes conveying the bobbins from the ring spinning machine to the winder in sequence in relation to the respective spinning stations of the ring spinning machine, and measuring, counting and sorting the bobbins between the ring spinning machine and winder. The measuring includes sensing the presence of a bobbin and the counting includes counting the bobbins sensed by the measuring and determining the spinning station at which each bobbin was spun. The measuring also includes sensing yarn and bobbin characteristics and comparing the sensed characteristics with predetermined standards for such characteristics. The sorting includes separating from the bobbins being conveyed to the winder those bobbins whose sensed characteristics differ from the predetermined standards. The method also includes evaluating the sensed characteristics in relation to the spinning stations to determine the quality of operation at the related spinning stations.

In the device of the present invention, means for conveying the bobbins is provided along with means for measuring, means for counting, means for sorting and means for evaluating, which means perform the functions of the method described above.

Preferably, the evaluating is responsive to the measuring and counting to provide an indication of spinning stations at which those bobbins whose sensed characteristics differ from the predetermined standard have been spun.

For a more complete automatic monitoring, the operation of the spinning stations may be sensed to obtain data, e.g. yarn breaks, down time, operating speeds, yarn size, yarn twist and draft, and providing data thereof, with this data then being evaluated in combination with data from the aforesaid measuring. This evaluation then provides an indication that can be utilized in controlling operations of the machine. This evaluating can relate to operating characteristics of individual spinning stations and of all the stations combined.

Similarly, sensing of the operations of the winder and providing data thereof may be included in the method of the present invention. With this arrangement the evaluating evaluates the winder operation data in combination with the spinning stations operation data and data from the measuring, with the indications from the evaluation being applied for either designating the evaluation, controlling production, controlling bobbin conveyance, or grading the wound packages. In the preferred embodiment the winder operation data is collected at the winder and transmitted to the evaluating location. Also in the preferred embodiment, the winder operation sensing senses yarn breaks, clearer cuts, thin and thick yarn locations, double yarns, tying and splicing attempts and winding head disturbances.

Also, in the preferred embodiment, the measuring includes sensing the type of yarn on the bobbins and includes emitting an alarm signal with a spinning station designation when an incorrect type of yarn is sensed on a bobbin.

Alternatively, the sorting according to the preferred embodiment includes predetermined separating of bobbins spun at predetermined spinning stations with the predetermined separating being independent of the sensing of yarn and bobbin characteristics. With this arrangement different types of yarns or yarn with different spun characteristics can be spun in the same machine and wound separately.

In the device of the present invention, means for conveying the bobbins is provided along with means for measuring, means for counting, means for sorting, means for evaluating, spinning stations operating sensing means, winding operation sensing means, data collecting and transmitting means, applying means, and alarm signal emitting means, which means perform the functions of the method described above.

The yarn and bobbin characteristics that may be sensed in application of the present invention include, for example, the hairiness of the yarn, the yarn material, the form of the bobbin, or the surface of the bobbin. Those bobbins that deviate from the standards or have yarn that deviates from the standards may be separated for rejection or conveyance to separate winding stations. Also, the monitoring can be used to determine the quality of production at individual spinning stations or in sections of the machine or in the machine overall.

The present invention can be utilized as described to determine quality deficiencies. For example, if quality deviations are evaluated as occurring in the same section of the spinning machine or at the same spinning stations in successive bobbins, it can be concluded that the low quality results from operation of the section or individual station. On the other hand, if the low quality is unevenly distributed throughout the bobbins, it is more likely that the yarn material is of uneven quality or production quality is substandard in the preparation of the yarn prior to being processed on the spinning machine.

In a more refined form of the invention, recorded measured data is combined statistically and displayed or automatically applied to control operation of the machine. In this manner errors and conditions which reduce production can be determined and dealt with more rapidly and precisely than heretofore.

In evaluating data relating to yarn breaks, down time, spinning speed (e.g. spindle rpms), yarn size, yarn twist and draft, the data can be utilized to indicate the cause or location of substandard quality. Thus, if yarn size, yarn twist and draft deviate from standard values without yarn breaks, down time and spinning speed deviations, then the low quality would be primarily in the spinning stations. If on the other hand, both categories of data deviate from standard, the problem may be in the roving that is supplied to the machine. If yarn size, yarn twist and draft are within standard quality requirements and only the yarn breaks, down time or spinning speed deviate from standard, the problem is probably in the yarn material or roving.

It is rather infrequent that incorrect yarn material is fed to a spinning station. However, if this occurs and it is not recognized immediately, considerable loss of production can result. This is avoided in the present invention by the above described sensing of incorrect yarn and emitting an alarm signal which can be used to immediately stop production and replacement of the supply bobbin at the designated station.

Other and further features and advantages of the present invention are apparent from the accompanying drawings and the following detailed description of the preferred embodiments.

BRIEF DESCRIPTION OF THE DRAWINGS

FIG. 1–5 are diagrammatic illustrations of the preferred embodiments of the present invention incorporated in a textile machine.

DETAILED DESCRIPTION OF THE PREFERRED EMBODIMENTS

Figure 4:
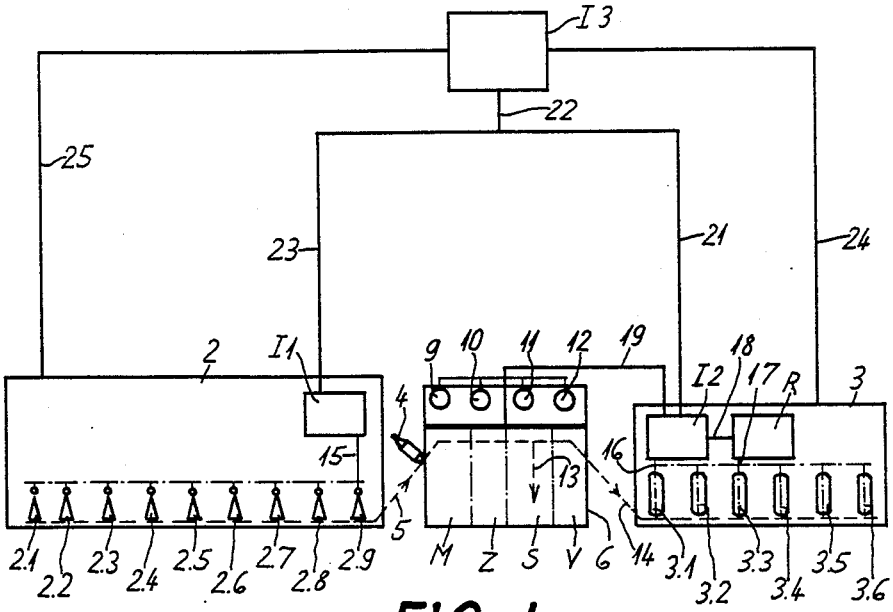

Referring to FIG. 1, a textile machine is shown consisting of a ring spinning machine 2 and an automatic winder 3. The ring spinning machine 2 has a large number of spinning stations, only several of which are illustrated. These are designated by the reference numerals 2.1 through 2.9. The automatic winder 3 has winding stations designated by the reference numerals 3.1 through 3.6. Bobbins 4 produced by the ring spinning machine 2 are conveyed on a conveyor belt 5 in a predetermined sequence to a measuring, counting and sorting device located between the ring spinning machine 2 and the automatic bobbin winder 3. This device is designated in its entirety by the reference numeral 6. Cross-wound packages 7 are produced at the winding stations 3.1 through 3.6 of the automatic bobbin winder 3 from the bobbins supplied from the ring machine 2.

The device 6 is a multi-function device with a counting component Z, a measuring component M, a sorting component S, and a preparation component V. The measuring component M includes a first sensing unit 8 that senses a bobbin 4 on the conveyor belt 5. The counting component Z is responsive to the first sensing unit 8 to count bobbins. The measuring component M includes a second sensor 9 for sensing the hairiness of the windings on the bobbin. A third sensing unit 10 senses the form of the bobbin. A fourth sensing unit 11 senses the type of yarn material on the bobbin. A fifth sensing unit 12 senses the weight of the bobbin.

The values sensed by the sensing units 9 through 12 are compared with predetermined standard values and any bobbins whose sensed characteristics differ from the predetermined standards are separated by the sorting component S along a transport path 13. Those bobbins that are not separated are conveyed to the preparation component V where the yarn end on the bobbin is prepared in readiness for engagement in the winder. From the preparation component V, the bobbins are conveyed sequentially in response to demand from one of the winding stations 3.1 through 3.6 on a conveyor belt 14 to the demanding winding station of the automatic winder 3. After the yarn is removed from the bobbins in the winding stations, the empty tubes are returned on a conveyor (not shown) back to the ring spinning machine 2 for winding of yarn thereon at the winding stations.

Operation of the spinning stations is monitored to obtain data, such as the number of yarn breaks, the down time, the spindle rpms or spinning speed, and this data is evaluated by a programmable computer-type processor I1, which is connected by leads to the individual spinning stations 2.1 through 2.9, such as by the lead 15 from the spinning position 2.9.

Operation of the winding stations is monitored to obtain data, such as the number of yarn breaks, clearer cuts, thick and thin yarn locations, double yarns, tying and splicing attempts and winding station disruptions, and this data is evaluated by a programmable computer-type processor I2, which is connected by leads to the individual winding stations 3.1 through 3.6, such as by the lead 16 from the winding position 3.1.

The automatic winder 3 also includes for each winding station a clearer R, which determines whether the yarn is running, senses thick and thin areas in the yarn and performs clearing cuts. Each interruption of the yarn results in a stoppage of the winding station, which requires subsequent knotting or splicing and resumption of the winding operation. Automatic knotting or splicing devices are used, but are not illustrated as they are of conventional construction. The clearers R are connected to the individual winding stations by leads. For example, lead 17 connects the winding station 3.3 to the clearer R. As the processor I2 also collects the data from clearer R, it is connected to the clearer R by lead 18. The other clearers are similarly connected.

The results of the sensing by the sensing unit 9 through 12 in comparison with the standard characteristics can be performed in the measuring component M itself. This is the situation in the embodiment of FIG. 1. The counting component Z sequentially counts the bobbins, including those that are sensed to be separated. Thus, a determination can be made based on the counting result regarding the section of the ring spinning machine 2 in which bobbins are produced with characteristics different from the standard. The information collected in the processor I1 also provides for evaluation of the bobbin and yarn quality as well as the quality of production of the individual spinning stations. The data collected in the processor I2 provides evaluation regarding the quality of the cross-wound packages and the quality of the winding operations at the individual winding stations.

The evaluation of the sensed data may be performed other than at the device 6 or measuring component M. For example, in FIG. 2, the evaluating function is performed by the processor I2, for which purpose the sensing units 9 through 12 and the counting and sorting components are connected by lead 19 to the processor I2. In this arrangement, the data can be evaluated and signals generated to indicate conditions or control the operation of the spinning and winding stations.

Rather than using the processor I2, the processor I1 of the ring spinning machine could be used for this same purpose, for example, by a lead 20 from the sensing units 9 through 12 and measuring, counting and sorting device 6 to the processor I1. Alternatively, both processors I1 and I2 could be connected to the measuring, counting and sorting device 6 to distribute the functions of evaluating between the two processors and used in combination with data from the machine with which it is associated.

A modified embodiment is illustrated in FIG. 3 where the data from the measuring, counting and sorting device 6 is connected by lead 19, processor I2 and leads 21 and 22 to a central evaluating unit in the form of a processor I3. The data collected by the processor I1 of the ring spinning machine 2 is similarly connected by lead 23 to the processor I3. Processor I2 also supplies the data collected from the automatic winder 3. In this arrangement the evaluation of the data occurs primarily in processor I3. Display devices 27 and 28 and message devices 29 and 30 are included in the processor I3.

A further embodiment is illustrated in FIG. 4, which differs from the embodiment of FIG. 3 primarily in that the processor I3 of FIG. 4 is capable of controlling by lead 24 the automatic winding operation and by lead 26 the automatic spinning operation. This arrangement utilizes evaluation of data regarding yarn breaks, running times, spindle rpms of the spinning machine, package weight, hairiness, diameter and form of the bobbins, and yarn position of the bobbins passing through the measuring, counting and sorting device, data regarding Uster standards, clearer adjustments, splicer times, improper joinings, winding speed, clearer cuts, and yarn breaks at the winding stations of the winder. Signals may be transmitted in both directions through leads 21, 22 and 23.

Figure 5:
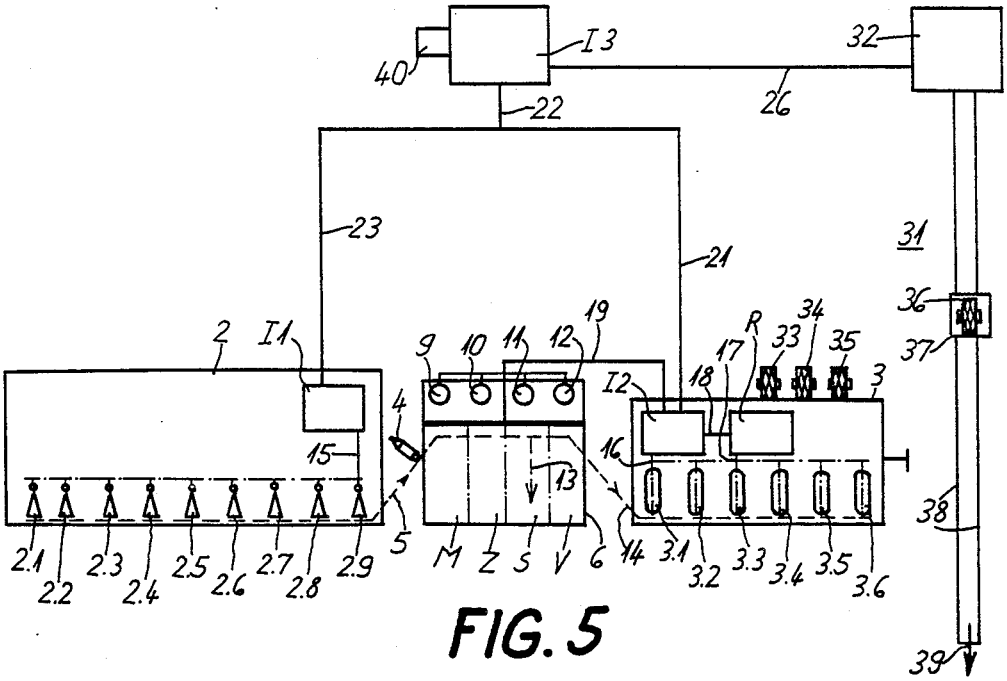

Referring to FIG. 5, a variation of the embodiment of FIG. 3 is illustrated in which data can be transmitted by lead 26 to a computer 32 that controls a transport system 31 that transports the cross-wound packages 33, 34, 35 and 36 produced on the automatic winder. This transport is accomplished by a carrier 37 riding on a track 38 in the direction of the arrow 39. The computer 32 controls the operation of the transport means 31 by information from the processor I3 regarding the yarn type and package quality of the individual packages. High quality packages can be automatically separated from low quality packages in this manner, for example, according to commercial grades. Differences in quality can result from the length of yearn on the package, the weight of the package, the package size or the winding density. The latter characteristic is of particular significance in packages that are to be dyed. Also, loosely wound packages can be processed further separately from more tightly wound packages. Thus, the disadvantage of having a mixture of unequal packages can be avoided by this arrangement.

The processor I3 can perform a statistical evaluation and the data and evaluation can be printed out on a printer 40 connected to the processor I3.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of monitoring the quality of yarns and wound packages produced and the quality of operation at production stations in a textile machine in which at least one ring spinning machine is combined with at least one automatic winder, said method comprising conveying said bobbins from said ring spinning machine to said winder in sequence in relation to the respective spinning stations of said ring spinning machine, measuring, counting and sorting said bobbins between said spinning machine and said winder, said measuring includes sensing the presence of a bobbin, said counting includes counting the bobbins sensed by said measuring and determining the spinning station at which each bobbin was spun, said measuring further includes sensing yarn and bobbin characteristics and comparing said sensed characteristics with predetermined standards for said characteristics, said sorting includes separating from the bobbins being conveyed to the winder those bobbins whose sensed characteristics differ from said predetermined standards, and evaluating the sensed characteristics in relation to the spinning stations to determine the quality of operation at the related spinning stations.

2. A method according to claim 1 and characterized further in that said evaluation is responsive to said measuring and counting to provide an indication of spinning stations at which those bobbins whose sensed characteristics differ from the predetermined standard have been spun.

3. A method according to claim 1 and characterized further by sensing the operation of the spinning stations and providing data thereof, evaluating the sensed spinning stations operation data in combination with data from said measuring, and providing an indication of the evaluation.

4. A method according to claim 3 and characterized further in that said spinning stations operation sensing includes sensing one or more of yarn breaks, down time, operating speeds, yarn size, yarn twist and draft.

5. A method according to claim 4 and characterized further by evaluating said spinning stations operation sensing to provide data regarding the operating characteristics of individual spinning stations and of all the stations combined.

6. A method according to claim 3, 4 or 5 and characterized further by sensing the operation of the winder and providing data thereof, in that said evaluating evaluates said winder operation data in combination with said spinning stations operation data and data from said measuring, and by applying said indication for at least one of designating the evaluation, controlling production, controlling bobbin conveyance, or grading the wound packages.

7. A method according to claim 6 and characterized further by collecting said winder operation data at said winder and transmitting said data to said evaluating.

8. A method to claim 7 and characterized further in that said winder operation sensing senses yarn breaks, clearer cuts, thick or thin yarn locations, double yarns, tying and splicing attempts and winding head disturbances.

9. A method according to claim 6 and characterized further in that said winder operation sensing senses yarn breaks, clearer cuts, thick or thin yarn locations, double yarns, tying and splicing attempts and winding head disturbances.

10. A method according to claim 1 and characterized further in that said measuring includes sensing the type of yarn on the bobbins, and by emitting an alarm signal with a spinning station designation when an incorrect type of yarn is sensed on a bobbin 11. A method according to claim 1 and characterized further in that said sorting includes predetermined separating of bobbins spun at predetermined spinning stations with said predetermined separating being independent of said sensing of yarn and bobbin characteristics.

12. A device for monitoring the quality of yarns and wound packages produced and the quality of operation at production stations in a textile machine in which at least one ring spinning machine is combined with at least one automatic winder, said device comprising means for conveying said bobbins from said ring spinning machine to said winder in sequence in relation to the respective spinning stations of said ring spinning machine, means for measuring, means for counting and means for sorting said bobbins between said spinning machine and said winder, said measuring means sensing the presence of a bobbin, said counting means counting the bobbins sensed by said measuring and determining the spinning station at which each bobbin was spun, said measuring means sensing yarn and bobbin characteristics and comparing said sensed characteristics with predetermined standards for said characteristics, said sorting means separating from the bobbins being conveyed to the winder those bobbins whose sensed characteristics differ from said predetermined standards, and means for evaluating the sensed characteristics in relation to the spinning stations to determine the quality of operation at the related spinning stations.

13. A device according to claim 12 and characterized further in that said evaluating means is responsive to said measuring means and counting means to provide an indication of spinning stations at which those bobbins whose sensed characteristics differ from the predetermined standard have been spun.

14. A device according to claim 12 and characterized further by means sensing the operation of the spinning stations and providing data thereof, means evaluating the sensed spinning stations operation data in combination with data from said measuring means, and providing an indication of the evaluation.

15. A device according to claim 14 and characterized further in that said spinning stations operation sensing means senses one or more of yarn breaks, down time, operating speeds, yarn size, yarn twist and draft.

16. A device according to claim 15 and characterized further by means for evaluating sensing by said spinning stations operation sensing means and providing data regarding the operating characteristics of individual spinning stations and of all the stations combined.

17. A device according to claim 14, 15 or 16 and characterized further by means for sensing the operation of the winder and providing data thereof, in that said evaluating means evaluates said winder operation data in combination with said spinning stations operation data and data from said measuring means, and by means for applying said indication for at least one of designating the evaluation, controlling production, controlling bobbin conveyance, or grading the wound packages.

18. A device according to claim 17 and characterized further by means for collecting said winder operation data at said winder and transmitting said data to said evaluating means.

19. A device according to claim 18 and characterized further in that said winder operation sensing means senses yarn breaks, clearer cuts, thick or thin yarn locations, double yarns, tying and splicing attempts and winding head disturbances.

20. A device according to claim 17 and characterized further in that said winder operation sensing means senses yarn breaks, clearer cuts, thick or thin yarn locations, double yarns, tying and splicing attempts and winding head disturbances.

21. A device according to claim 12 and characterized further in that said measuring means senses the type of yarn on the bobbins, and by means for emitting an alarm signal with a spinning station designation when an incorrect type of yarn is sensed on a bobbin.

22. A device according to claim 12 and characterized further in that said sorting means separates bobbins spun at predetermined spinning stations independent of the sensed of yarn and bobbin characteristics.

* * * * *